US005428978A

United States Patent [19]

Tsukano

[11] Patent Number: 5,428,978

[45] Date of Patent: Jul. 4, 1995

[54] CYLINDER LOCK DEVICE RESISTIBLE AGAINST UNAUTHORIZED UNLOCKING

[75] Inventor: Tetsuyuki Tsukano, Kanagawa, Japan

[73] Assignee: Alpha Corporation, Kanagawa, Japan

[21] Appl. No.: 219,089

[22] Filed: Mar. 29, 1994

[51] Int. Cl.[6] ..... E05B 17/04

[52] U.S. Cl. ..... 70/386; 70/276; 70/379 R; 70/367

[58] Field of Search ..... 70/386, 276, 263–265, 70/237, 238, 379 R, 380, 490, 492, 367

[56] References Cited

U.S. PATENT DOCUMENTS

| | | | |
|---|---|---|---|
| 3,197,985 | 8/1965 | Cosio | 70/367 |
| 4,326,396 | 4/1982 | Steinbach | 70/492 |
| 4,395,893 | 8/1983 | Steinbach | 70/492 |
| 4,563,885 | 1/1986 | Madden | 70/380 |
| 4,829,798 | 5/1989 | Roop | 70/380 |
| 5,044,183 | 9/1991 | Neyret | 70/380 |
| 5,265,453 | 12/1993 | Konii et al. | 70/380 |
| 5,339,663 | 8/1994 | Döring | 70/379 R |

FOREIGN PATENT DOCUMENTS

| | | | |
|---|---|---|---|
| 2821901 | 12/1978 | Germany | 70/264 |

*Primary Examiner*—Peter M. Cuomo
*Assistant Examiner*—Monica E. Millner
*Attorney, Agent, or Firm*—Bachman & LaPointe

[57] ABSTRACT

A cylinder lock device (10) includes a lever (15) rotatably disposed between a casing (11) and a key cylinder (13), and a blocking member (17) disposed within a notch (16) formed in the lever (15). A concavity (18) are formed on an inner wall of the casing (11), and a chamfer (19) is formed on the key cylinder (13). When the lever (15) is in the locked position and the key cylinder (13) is further rotated to the dead-locked position over the locked position, the blocking member (17) moves away from the chamfer (19) of the key cylinder (13) and into the concavity (18) of the casing (11). When the key is pulled out from the key cylinder in the dead-locked position, the locking device is forcibly maintained in the locked position to prevent unauthorized unlocking.

15 Claims, 13 Drawing Sheets

CYLINDER LOCK DEVICE RESISTIBLE AGAINST UNAUTHORIZED UNLOCKING

FIELD OF THE INVENTION

The present invention relates, in general, to a lock and more particularly, to a cylinder lock device firmly resistible against unauthorized unlocking by tampering.

PRIOR ART

For example, Japanese Patent Disclosure No. 2-261178 discloses a cylinder lock used for vehicle doors. The cylinder lock of this kind comprises a casing provided with a hole; a key cylinder rotatably disposed within the hole of the casing; a first lever attached with angular clearance to the key cylinder and drivingly connected to a locking device equipped on a door; a spring for resiliently urging the first lever when rotated; a stopper provided on the casing for preventing rotation of the first lever over a predetermined rotated angle; and a second lever attached to the key cylinder.

In this cylinder lock, during rotation of the key cylinder with a correct key, the first and second levers are rotated together with the key cylinder to lock or unlock the locking device. When the key cylinder is rotated from the neutral to the locked or unlocked position, the first lever is stopped upon contact with the stopper after the first lever shifts the locking device to the locked or unlocked condition. Due to the angular clearance between the first and second levers, while the first lever is kept in the stopped position by the stopper, the second lever is further rotated to an over position angularly away from the stopped position of the first lever, and operates a lock switch. Upon operation of the lock switch by the second lever, it produces an electric signal to actuate other locking devices for locking or unlocking. Thus, in this system, utilization of a single key realizes sequential and selective operation to lock or unlock a plurality of the locking devices, avoiding troublesome individual operation of the plural locking devices.

In another aspect, new cylinder locks are recently required which are fully resistible against unauthorized unlocking by tampering locking devices. In other wards, locking devices may inconveniently be unlocked by tampering, with a specific tool, a lock knob provided in a vehicle door for manual operation of the locking device although the cylinder lock is kept in the locked condition.

Accordingly, an object of the present invention is to provide a novel cylinder lock device firmly resistible, against unauthorized attempt to unlock a locking device by tampering, by forcibly maintaining the locking device in the locked condition to bar unlocking of the locking device.

Another object of the present invention is to provide a cylinder lock device which can protect a locking device from unauthorized attempt to unlock by tampering a relating part of a locking device.

Still another object of the present invention is to provide a cylinder lock device which perfectly inhibit any operation of a locking device when the cylinder lock device is in the dead-locked position.

SUMMARY OF THE INVENTION

The cylinder lock device according to the present invention includes a casing which has a plurality of grooves formed in the casing; a key cylinder rotatably disposed within the casing; and tumblers slidably disposed in slots formed in the key cylinder for engagement with or disengagement from the grooves of the casing. The grooves are formed in the casing at angular intervals of 90 degrees. The cylinder lock device further comprises a lever rotatably mounted on the key cylinder, and a blocking member of a roller or ball disposed for rotation together with the lever from a unlocked or neutral position to a locked position. The blocking member is received within a concavity formed on the casing to forcibly maintain the locking device in the locked position in order to inhibit unlocking thereof when the key cylinder is in a dead-locked position over the locked position.

The blocking member is retained within a notch formed in the lever and on a chamfer formed on the key cylinder for rotation together with the key cylinder when the key cylinder is rotated from a neutral or unlocked position to a locked position. The blocking member can move away from the chamfer of the key cylinder and into the concavity formed on an inner wall of the casing when the key cylinder is further rotated over the locked position to the dead-locked position to prevent returning rotation of the key cylinder to the neutral or unlocked position. A key is inserted into or pulled from the key cylinder in the neutral or unlocked position or in the dead-locked position of the key cylinder.

The lever rotates with the blocking member retained in the notch formed between a pair of arcuate lugs of the lever when the key cylinder is rotated by a key until the blocking member is received within the concavity of the casing. Secured to the key cylinder for rotation between the unlocked and dead-locked positions is a bracket which is provided with a magnet detected by a magnetic sensor to indicate the position of the key cylinder.

When the key cylinder is rotated from a neutral or unlocked position to a locked position, the lever is rotated together with the key cylinder. Simultaneously, the blocking member is rotated from the neutral or unlocked position to the locked position in the condition disposed within the notch of the lever and on the chamfer of the key cylinder. When the key cylinder is further rotated from the locked position to the dead-locked position, the blocking member moves away from the chamfer of the key cylinder and into the concavity of the casing for engagement.

After the key is pulled out from the key cylinder in the dead locked position, the key cylinder is firmly kept in the dead-locked position so that the lever and the locking device can be forcibly maintained in the locked position, thereby preventing unauthorized unlocking of the locking device although an external force is applied to any relating part connected with the locking device.

DETAILED DESCRIPTION OF THE INVENTION

Figure 1:
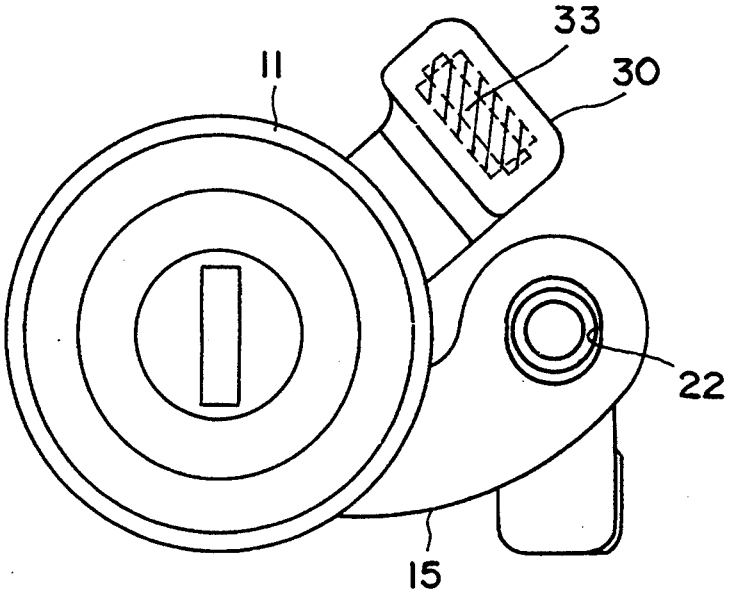
FIG. 1 is a front view of a cylinder lock device according to the present invention.
Figure 2:
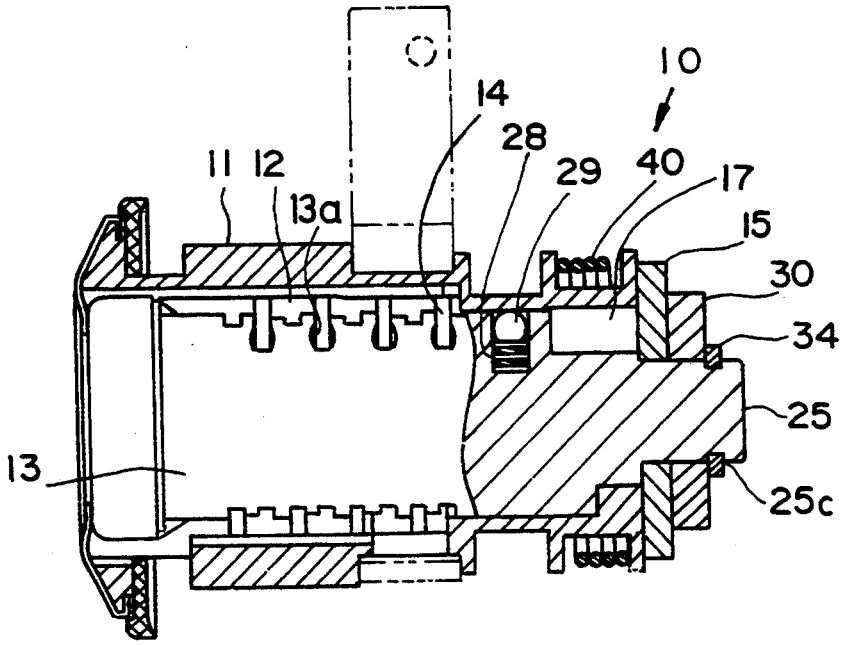
FIG. 2 is a longitudinal-section view of the cylinder lock device.

Referring to FIG. 1 to FIG. 30, an embodiment of the cylinder lock device according to the present invention will be described as follows.

The cylinder lock device 10 according to the present invention comprises a casing 11 formed with a hole 11*a* and four longitudinal grooves 12, a key cylinder 13 rotatably disposed within the hole 11*a* of the casing 11 and tumblers 14 slidably disposed within slots 13*a* formed in the key cylinder 13. The grooves 12 are formed at angular intervals of 90 degrees on an inner wall 11*c* of the hole 11*a* of the casing 11 such that the tumblers 14 are moved between their retracted position within the slots 13*a* for rotation of the key cylinder 13 and extended position projecting from the slots 13*a* for engagement with the grooves 12, similarly to prior art cylinder locks.

A key may be inserted into and pulled out from the key cylinder 13 when the tumblers 14 move into and away from the grooves 12.

A lever 15 has a central hole 24 to receive a central protrusion 25 of the key cylinder 13 so that a cylindrical portion 25*a* of the central protrusion 25 is in contact with the hole 24. The lever 15 has also an arm 23 formed with a hole 22 to receive a rod (not shown) drivingly connected with a door locking device of a vehicle door; a pair of arcuate lugs 20 rotatably disposed between the casing 11 and the key cylinder 13 (FIG. 9); and a notch 16 axially extending between these arcuate lugs 20. A blocking member 17 of for example a roller or ball is disposed in the notch 16 and on a U-shaped chamfer 19 formed in the key cylinder 13.

A bracket 30 is attached to the end portion of the key cylinder 13 adjacent to and outward of the lever 15. The bracket 30 has an opening 31 of substantially oval or non-circular shape in section to receive a notched portion 25*b* of the central protrusion 25 of the key cylinder 13 for integral rotation of the bracket 30 and the key cylinder 13.

Figure 3:
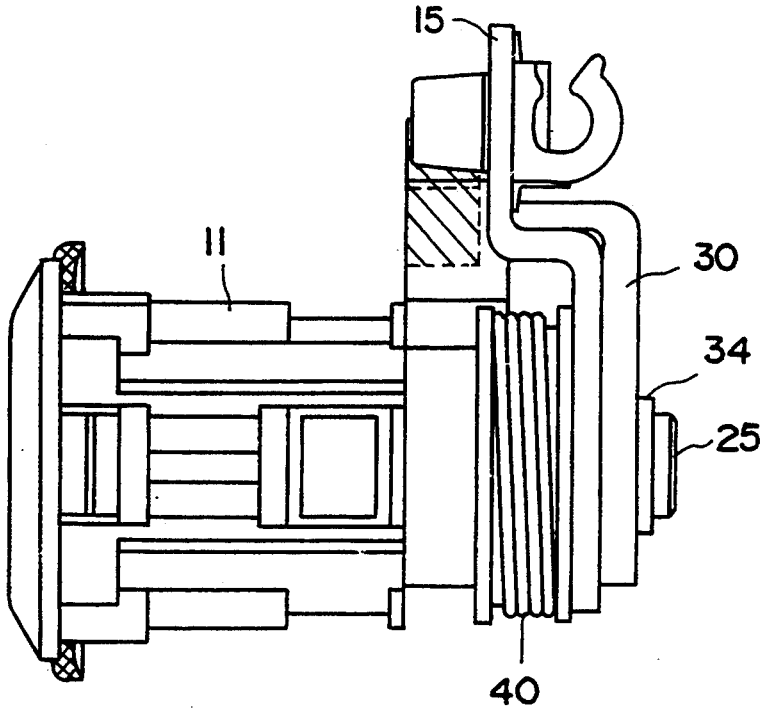
FIG. 3 is a side view of the cylinder lock device.
Figure 4:
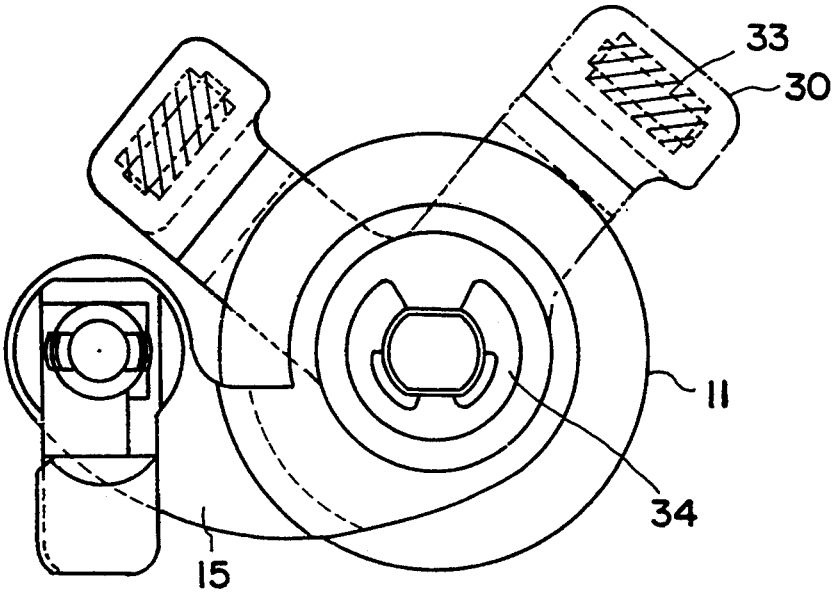
FIG. 4 is a rear view of the cylinder lock device.
Figure 5:
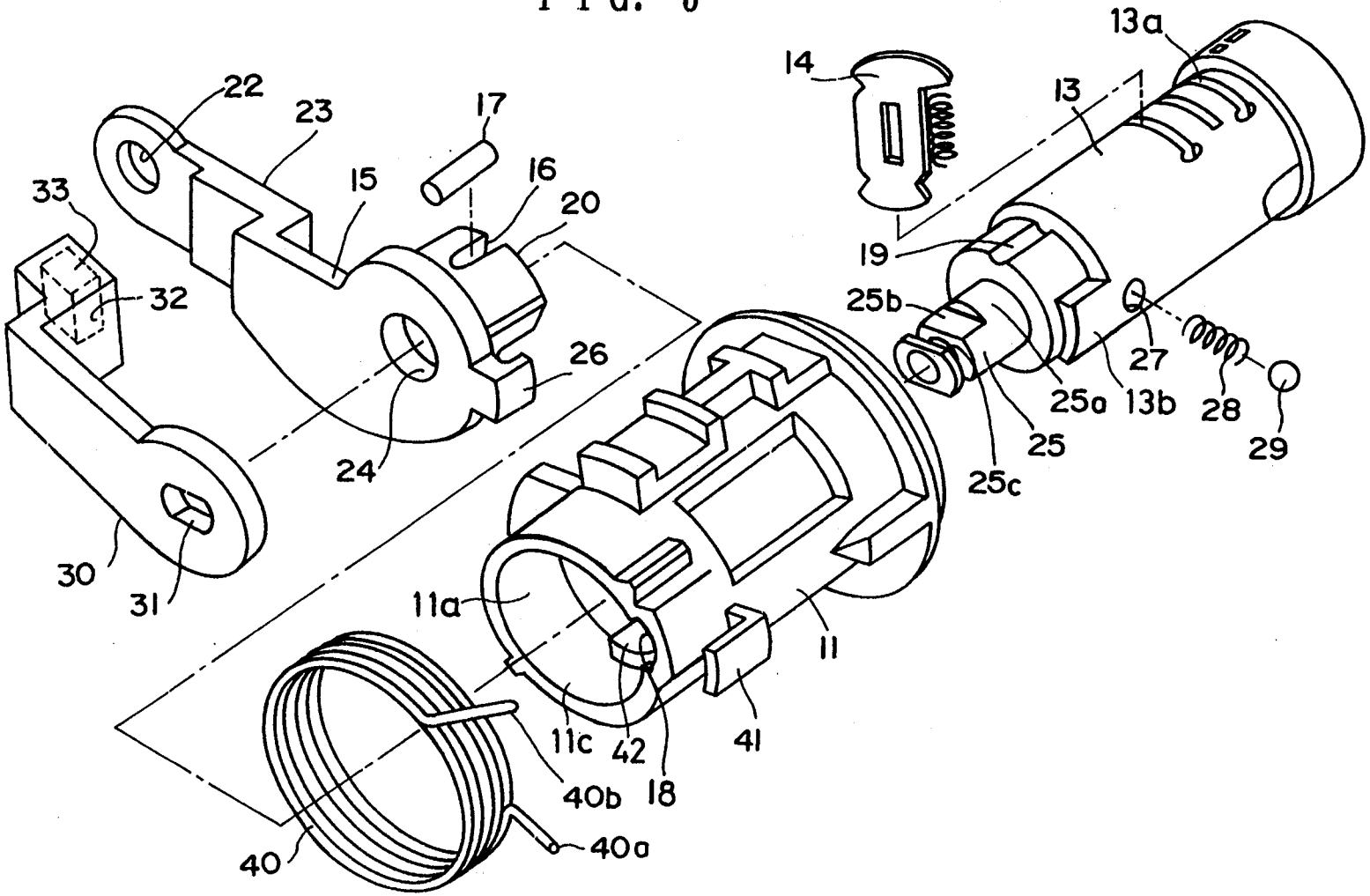
FIG. 5 is an exploded view of the cylinder lock device.
Figure 6:
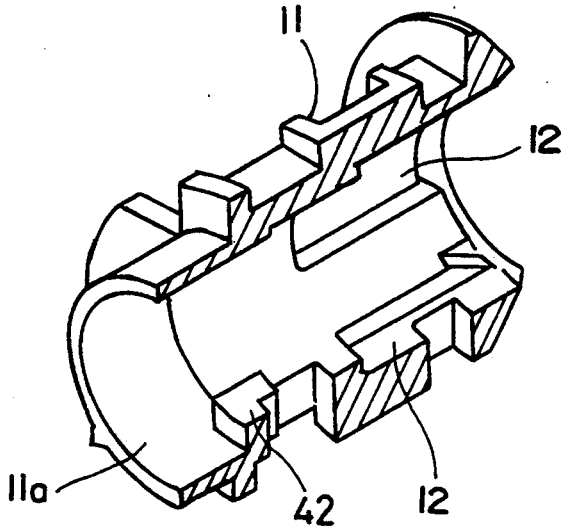
FIG. 6 is a perspective view showing longitudinal section of a casing.

A magnet 33 is secured in a recess 32 formed at the end portion of the bracket 30. As shown in FIG. 3, an E-shaped ring 34 is attached to an annular recess 25*c* of the center protrusion 25 outward of the bracket 30 to prevent detachment of the lever 15 and the bracket 30 from the center protrusion 25.

Figure 9:
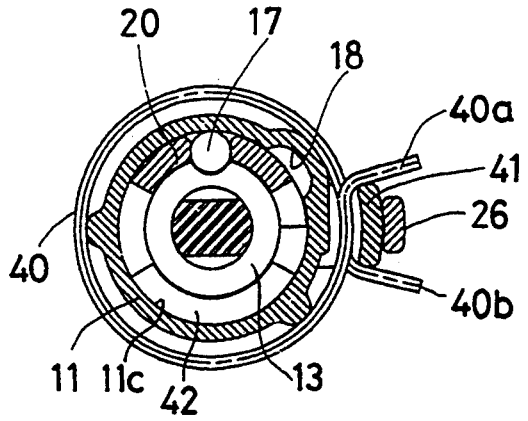
FIG. 9 is a cross-section view of the cylinder lock device in the neutral position showing a blocking member.

As shown in FIG. 9, wound around the casing 11 is a coiled spring 40 having two ends 40*a* and 40*b* between which L-shaped lugs 26 and 41 of the lever 15 and casing 11 are positioned in a radially overlapped condition so that the coiled spring 40 applies an elastic returning force to the key cylinder 13 when the key cylinder 13 is rotated from the neutral position of FIG. 9 in either direction. The key cylinder 13 has an integrally formed protrusion 13*b* which is brought into contact with a stopper 42 formed on the inner wall 11*c* of the hole 11*a* of the casing 11 to bar further rotation of the key cylinder 13 when the key cylinder 13 is rotated to the dead-locked position. Also, when the lever 15 is fully rotated together with the key cylinder 13, either of the arcuate lugs 20 of the lever 15 is brought into contact with the stopper 42 to restrict further rotation of the lever 15.

Figure 7:
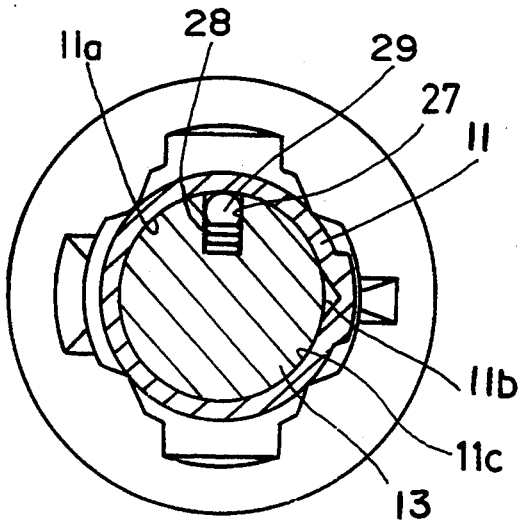
FIG. 7 is a cross-section view of the cylinder lock device in the neutral position showing a ball and a spring.
Figure 8:
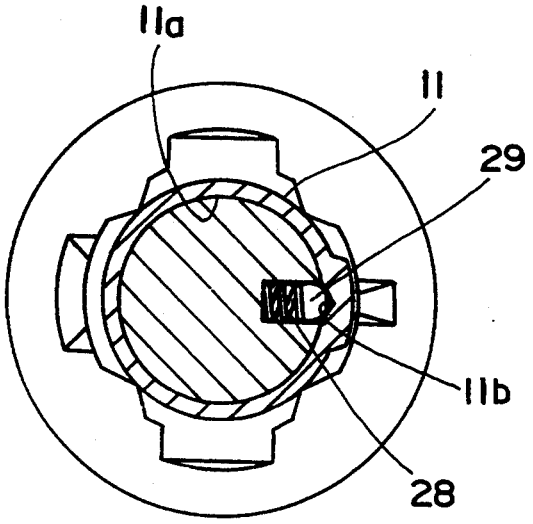
FIG. 8 is a cross-section view of the cylinder lock device in the deadlocked position showing the ball and the spring.
Figure 21:
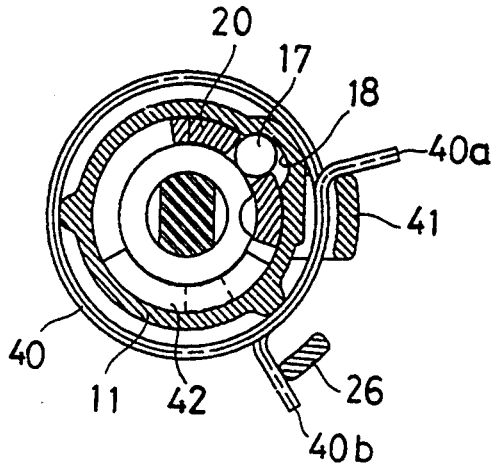
FIG. 21 is a cross-section view of the cylinder lock device with the key cylinder in the dead-locked position.
Figure 22:
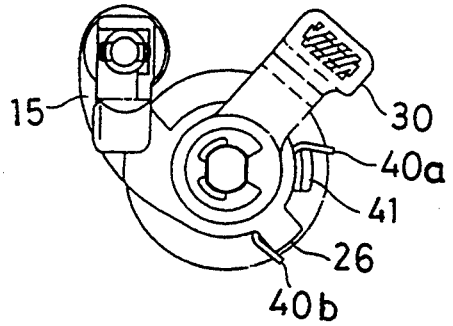
FIG. 22 is a rear view of the cylinder lock devices with the lever and the bracket in the dead-locked position.

A spring 28 and a ball 29 are disposed in a radial hole 27 formed in the key cylinder 13 as shown in FIG. 7 to resiliently urge the ball 29 by the spring 28 against the inner wall 11*c* of the casing 11 so that the ball 29 is engaged with a V-shaped recess 11*b* formed on the inner wall 11*c* of the casing 11 for click stop when the key cylinder 13 is rotated to the dead-locked position as shown in FIGS. 8, 21 and 22. An axial concavity 18 is formed on the inner wall 11*c* of the casing 11 to receive the blocking member 17 when the lever 15 is in the locked position.

Figure 10:
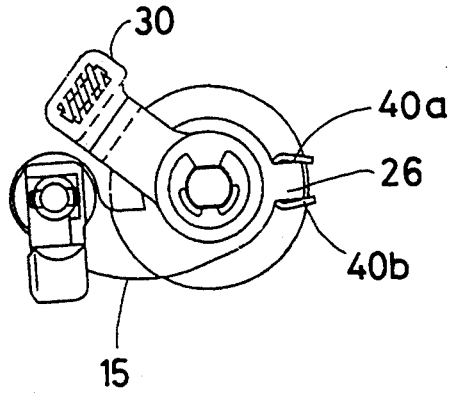
FIG. 10 is a rear view showing a lever and a bracket in the neutral position.
Figure 11:
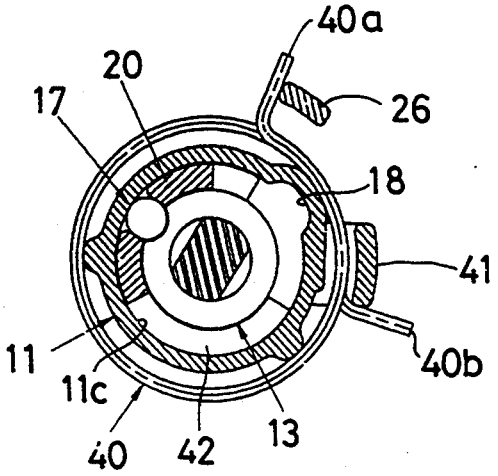
FIG. 11 is a cross-section view showing the blocking member in the unlocked position.
Figure 12:
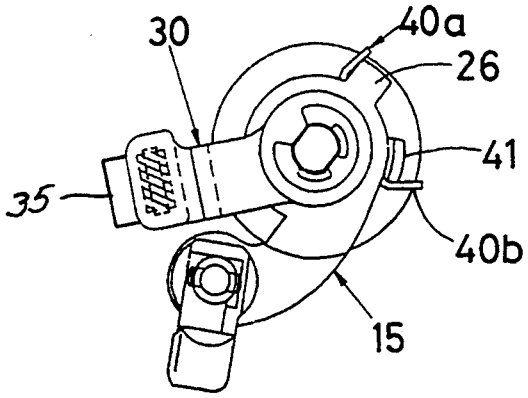
FIG. 12 is a rear view showing the lever and the bracket in the unlocked position.

When the cylinder lock device 10 is in the inoperative condition, the key cylinder 13, lever 15, blocking member 17 and bracket 30 are in the neutral position of FIGS. 9 and 10 wherein the blocking member 17 is received within the notch 16 of the lever 15 and on the U-shaped chamfer 19 of the key cylinder 13. When a key is inserted into the key cylinder 13 in the neutral position of FIGS. 9 and 10 and then rotated in a counterclockwise direction, the key cylinder 13 is rotated in the same direction together with the lever 15, blocking member 17 and bracket 30 to the unlocked position as shown in FIGS. 11 and 12. During the counterclockwise rotation, the blocking member 17 serves to connect the key cylinder 13 and the lever 15 for their integral rotation. In the unlocked position, one of the arcuate lugs 20 is brought into contact with the lug 42 of the casing 11 to stop rotation of the key cylinder 13 and lever 15, and thereby the arm 23 makes a locking device in the unlocking condition via a rod connected with the hole 22. Simultaneously, the lever 15 is rotated to the unlocked position so that the magnet 33 is detected by a ferrous sensor (not shown) which produces an electric signal representing that the bracket 30 is in the unlocked position.

The coiled spring 40 produces a returning force of the lever 15 when rotated to the unlocked position because the L-shaped lug 26 of the lever 15 is in contact with one end 40*a* of the expanded spring 40. Accordingly, when the key cylinder 13 is rotated to the unlocked position and a manual rotating force in the counterclockwise direction is removed from the key, the key cylinder 13, lever 15 and bracket 30 are automatically returned from the unlocked to the neutral position by resilient force of the coiled spring 40.

Figure 13:
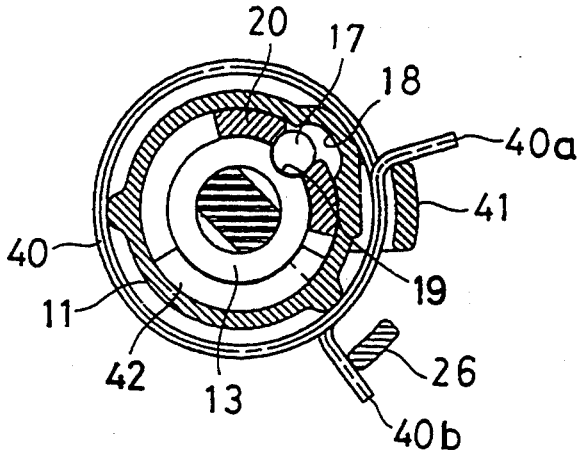
FIG. 13 is a cross-section view of the cylinder lock device with the key cylinder angularly rotated by 45 degrees from the neutral toward the locked position.
Figure 14:
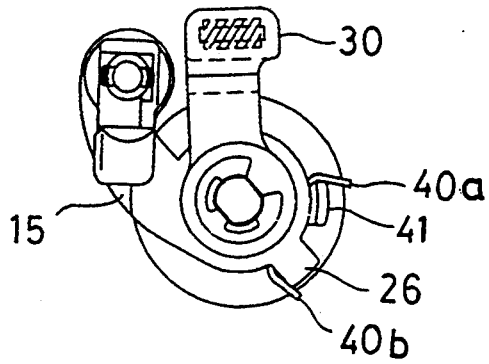
FIG. 14 is a rear view of the cylinder lock device with the key cylinder angularly rotated by 45 degrees from the neutral toward the locked position.

Adversely, when the key is rotated to the locked position, the key cylinder 13 is rotated in the clockwise direction as shown in FIGS. 13 and 14 from the neutral position toward the locked position together with the lever 15, blocking member 17 and bracket 30. When the key cylinder 13 reaches the locked position of FIGS. 15 and 16, one of the arcuate lugs 20 comes into contact with the lug 42 of the casing 11 to stop rotation of the lever 15 so that the locking device is locked by the rod connected with the lever 15 and the magnet sensor 35 detects the locked position of the magnet 33 attached to the bracket 30. At this time, the other end 40*b* of the coil spring 40 resiliently urges the L-shaped lug 26 to rotate the lever 15 toward the neutral position so that the key cylinder 13 automatically returns to the neutral position when rotating force is removed from the key.

Figure 15:
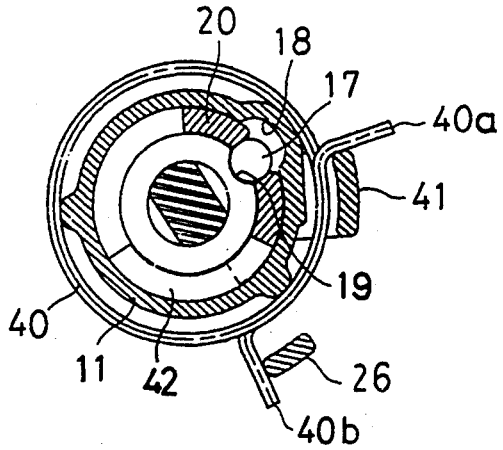
FIG. 15 is a cross-section view of the cylinder lock device with the key cylinder angularly rotated by 60 degrees from the neutral toward the locked position.
Figure 16:
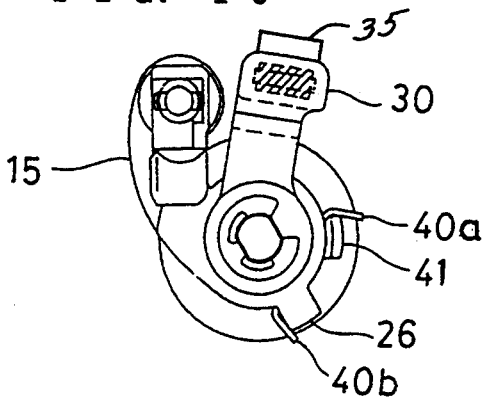
FIG. 16 is a rear view of the cylinder lock device with the key cylinder angularly rotated by 60 degrees from the neutral toward the locked position.
Figure 17:
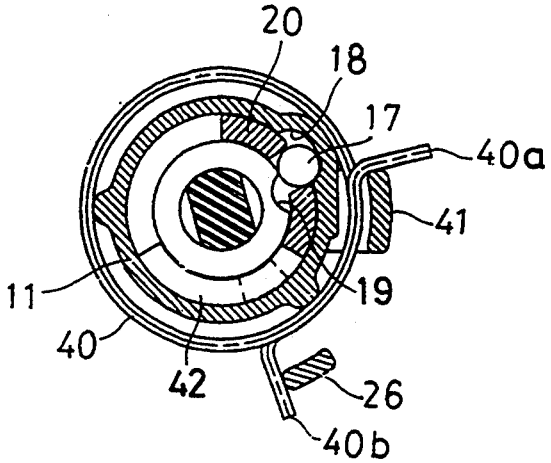
FIG. 17 is a cross-section view of the cylinder lock device with the key cylinder angularly rotated by 75 degrees from the neutral toward the locked position.
Figure 18:
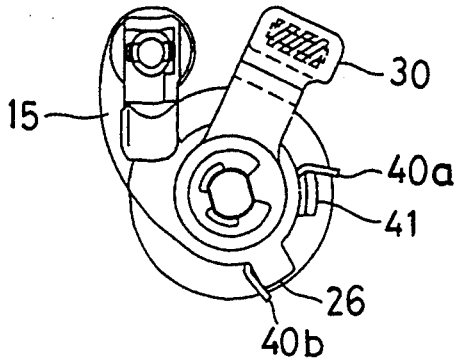
FIG. 18 is a rear view of the cylinder lock device with the key cylinder angularly rotated by 75 degrees from the neutral toward the locked position.
Figure 19:
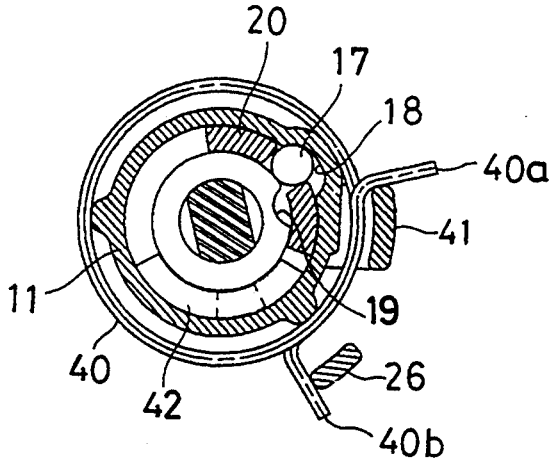
FIG. 19 is a cross-section view of the cylinder lock device with the blocking member returned from the angular position of FIG. 17 by a coiled spring to an angular position of 48.5 degrees.
Figure 20:
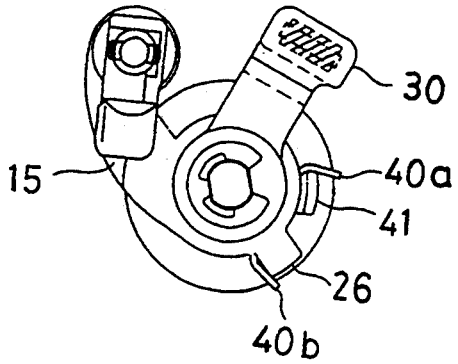
FIG. 20 is a rear view of the cylinder lock device with the lever and the bracket returned from the angular position of FIG. 18 by the coiled spring to the angular position of 48.5 degrees.

When the lever 15 is stopped in the locked position due to contact of one of the arcuate lugs 20 with the lug 42 of the casing 11, the key cylinder 13 is further rotated in the clockwise direction with the key from the locked position shown in FIGS. 15 and 16 to the dead-locked position shown in FIGS. 1 and 22. The blocking member 17 in the notch 16 of the lever 15 moves away from the U-shaped chamfer 19 into the concavity 18 of the casing 11 as shown in FIG. 17, and therefore the lever 15 is slightly reversely rotated in the counterclockwise direction by elastic force of the coil spring 40 as shown in FIGS. 19 and 20 so that the blocking member 17 is moved to contact an edge of the concavity 18. With a further clockwise rotation, the key cylinder 13 may be rotated to the dead-locked position shown in FIGS. 21 and 22. As the dead-locked position of FIGS. 21 and 22 is angularly away from the neutral position of FIGS. 9 and 10 by 90 degrees, the key may be pulled out from the key cylinder 13 with the tumblers 14 protruded within the groove 12. Thus, in the dead-locked position of the key cylinder 13, the lever 15 is firmly fixed in the locked position together with cooperating parts drivingly connected with the lever 15 so that the key cylinder 13 is barred to be returned to the neutral position, causing prevention of unauthorized unlocking by tampering operation of the relating parts of the locking device with tools.

Figure 23:
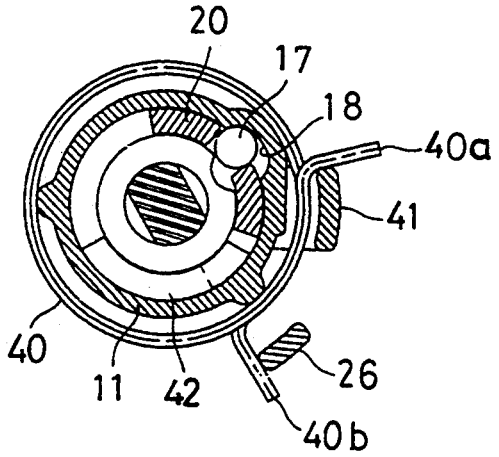
FIG. 23 is a cross-section view of the cylinder lock device with the key cylinder returned to the angular position of 60 degrees.
Figure 24:
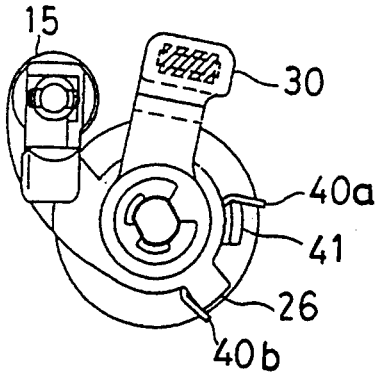
FIG. 24 is a rear view of the cylinder lock device with the bracket returned to the angular position of 60 degrees.
Figure 25:
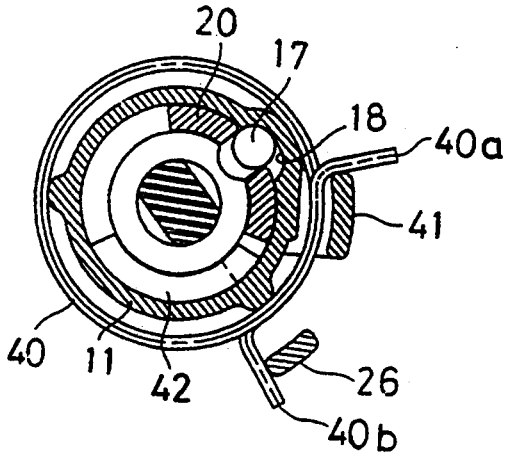
FIG. 25 is a cross-section view of the cylinder lock device with the key cylinder returned to the angular position of 48.5 degrees.
Figure 26:
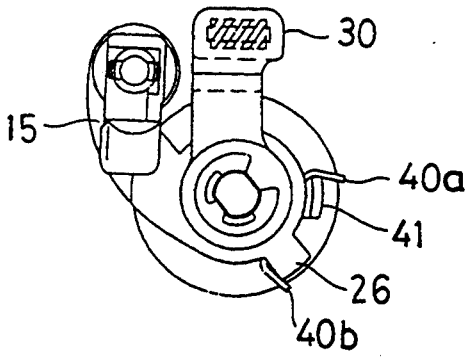
FIG. 26 is a rear view of the cylinder lock device with the bracket returned to the angular position of 48.5 degrees.
Figure 27:
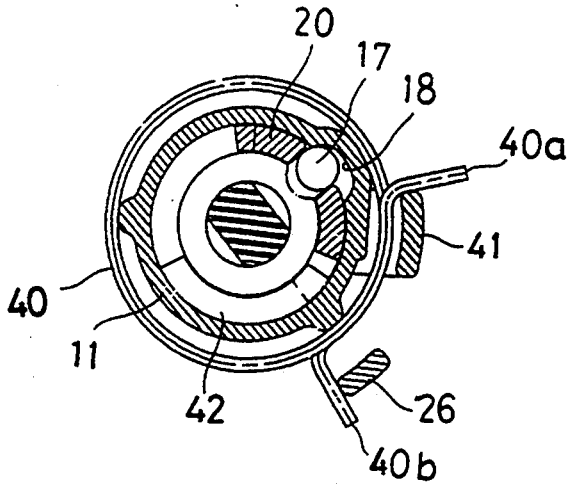
FIG. 27 is a cross-section view of the cylinder lock device with the key cylinder returned to the angular position of 48 degrees.
Figure 28:
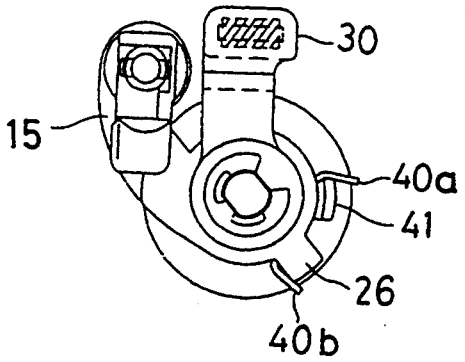
FIG. 28 is a rear view of the cylinder lock device with the lever returned to the angular position of 48 degrees.
Figure 29:
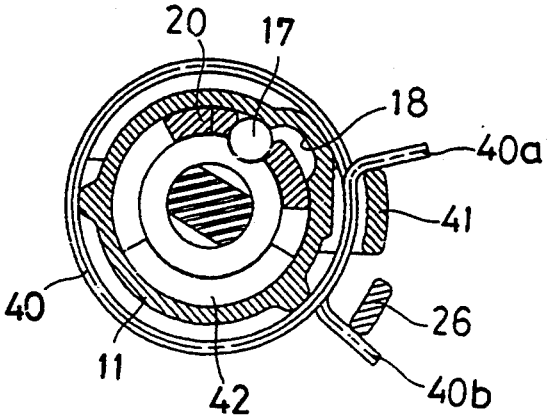
FIG. 29 is a cross-section view of the cylinder lock device with the key cylinder returned to the angular of 30 degrees.
Figure 30:
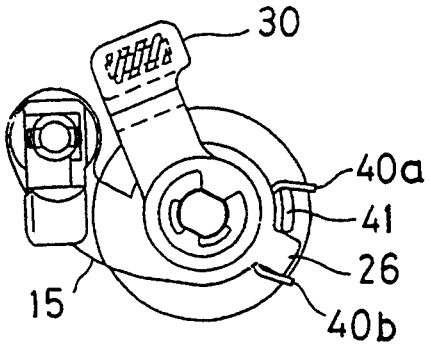
FIG. 30 is a rear view of the cylinder lock device with the lever and bracket returned to the angular position of 30 degrees.

To return the key cylinder 13 from the dead-locked position to the neutral position, a key is inserted into the key cylinder 13 in the deadlocked position and then rotated in the counterclockwise direction from the dead-locked position of FIGS. 21 and 22 through the position of FIGS. 23 and 24 to the position shown in FIGS. 25 and 26 in which the U-shaped chamfer 19 of the key cylinder 13 aligns with the notch 16 of the lever 15 so that the blocking member 17 moves away from the concavity 18 into the U-shaped chamfer 19 of the key cylinder 13 as shown in FIGS. 27 and 28. In this stage, the key cylinder 13 is automatically returned under elastic force of the coiled spring 40 together with the lever 15 to the neutral position of FIGS. 9 and 10 via the position of FIGS. 29 and 30.

As above-mentioned, when the key cylinder 13 is rotated from the neutral or unlocked position to the locked position, the blocking member 17 in the notch 16 of the lever 15 is rotated together with the cylinder 13 in contact with the chamfer 19 of the key cylinder 13. When the key cylinder 13 is further rotated from the locked position to the dead-locked position, the blocking member 17 is disengaged from the chamfer 19 of the key cylinder 13 and received in the concavity 18 of the casing 11 to prevent returning rotation of the lever 15 due to engagement of the blocking member 17 with the concavity 18 of the casing 11. When the key cylinder 13 is further rotated from the locked to the dead-locked position, the key can be pulled out from the key cylinder 13 to firmly retain the lever 15 and relating parts in the locked position, preventing tampering of the locking device for unauthorized unlocking. In this way, the key can be inserted into and pulled out from the key cylinder 13 at both of the neutral and dead-locked positions.

The modes of the present invention are not necessarily limited to the aforementioned embodiment, and may be modified in other ways. For example, an alarm device is connected to operate for indication of unauthorized unlocking when the locking device is shifted to the unlocked condition despite of the magnet 33 of the bracket 30 in the locked position.

In aforementioned embodiment, the key cylinder 13 can be rotated in opposite directions from the neutral to the unlocked or locked position, however, the structural design may be varied to rotate the key cylinder 13 in the full angular range of 360 degrees without the coiled spring 40.

In the cylinder lock device according to the present invention, unauthorized unlocking by, for example, tampering the relating parts such as a lock nob cooperating with the locking device by use of tools, is perfectly prevented as these parts are firmly fixed in the locked position by keeping the key cylinder in the deadlocked position.

What is claimed is:

1. A cylinder lock device, comprising:

a casing having a plurality of grooves formed therein, wherein said casing has a concavity formed on an inner wall thereof;

a key cylinder rotatably disposed within said casing, said key cylinder having slots therein and a chamfer formed thereon;

tumblers slidably disposed in said slots for engagement with or disengagement from said grooves of said casing;

a lever rotatably mounted on said key cylinder, said lever having a notch formed axially therein; and a blocking member disposed within said notch of said lever and rotatable with said lever from an unlocked position to a locked position, said blocking member also received within said chamfer of said key cylinder;

wherein said key cylinder is capable of being rotated from said locked position toward a deadlocked position to move said blocking member away from said chamfer to said concavity of said casing to forcibly maintain the locking device in the locked position.

2. The cylinder lock device according to claim 1, wherein said blocking member is retained within said notch of said lever and said chamfer of said key cylinder and is rotatable with said key cylinder when said key cylinder is rotated from said unlocked position to said locked position, said blocking member adapted to move from said chamfer of said key cylinder into said concavity upon the further rotation of said key cylinder over said locked position relative said lever to a deadlocked position wherein said lever is prevented from returning by rotation to the neutral position via said blocking member being engaged in said notch and concavity.

3. The cylinder lock device according to claim 1 wherein said blocking member is one of a roller and a ball.

4. A cylinder lock device according to claim 1, wherein said grooves are formed in said casing at angular intervals of 90°, said blocking member being disposed within said notch and on said chamfer for rotation with said key cylinder upon the rotation of said key cylinder from said unlocked to said locked position, said blocking member movable from said chamfer and into said concavity upon the rotation of said key cylinder from the locked to said deadlocked position to prevent said lever from returning to said unlocked position by rotation in said casing.

5. The cylinder lock device according to claim 4, wherein said key cylinder is adapted to have at least one of a key pulled therefrom while in said deadlocked position and a key inserted therein while in said deadlocked position.

6. The cylinder lock device according to claim 4, wherein said key cylinder is adapted to have one of a key inserted therein and a key pulled therefrom in said unlocked position.

7. The cylinder lock device according to claim 4, wherein said lever is adapted to rotate with said blocking member retained in said notch when said key cylinder is rotated via a key until said blocking member is received within said concavity.

8. The cylinder lock device according to claim 4, wherein said lever includes a pair of arcuate lugs which form said notch.

9. The cylinder lock device according to claim 4, further comprising a bracket secured to said key cylinder which rotates between said unlocked and said deadlocked position.

10. The cylinder lock device according to claim 9, wherein said bracket includes a magnet adapted to be detected by a magnetic sensor for indicating the position of the key cylinder.

11. The cylinder lock device according to claim 1, wherein said key cylinder is rotatable in a first direction for achieving said deadlocked position, said deadlocked position comprising said tumblers in said key cylinder being engaged with one of said grooves at a position beyond the locked position toward said first direction, wherein at said deadlocked position said blocking member remains engaged with said concavity and said tumblers remain engaged in said one of said grooves.

12. The cylinder lock device comprising:

an outer casing having an inner surface with a plurality of longitudinal grooves, said inner surface further including a concavity;

a key cylinder rotatably disposed in said casing, wherein said key cylinder has a plurality of slots and an axially extending chamfer;

a plurality of tumblers positioned in said slots which are adapted to engage with and disengage from said grooves for locking said key cylinder relative to said casing;

a lever rotatably mounted on said key cylinder and positioned between said key cylinder and said casing, wherein said lever includes an axially extending notch; and blocking member means for establishing a locked position as defined by said lever locked to said casing, wherein said blocking member means is movable into said locked position via the rotation of said key cylinder relative said casing and said lever having said notch.

13. The cylinder lock device according to claim 12, wherein said blocking member means comprises a rod-shaped member substantially unconnected and free moving between said chamfer, notch and concavity.

14. The cylinder lock device according to claim 13, wherein said chamfer is shaped in conformance with said blocking member means and is adapted to move said blocking member means into said concavity and from said chamfer after said chamfer, said notch and said concavity are substantially in alignment and said key cylinder and said chamfer are further rotated.

15. The cylinder lock device according to claim 12, wherein the casing includes an inner lug in which said lever is adapted to engage for stopping the rotation thereof and allowing relative motion between said key cylinder and said lever for establishing said locked position.

* * * * *